United States Patent [19]

Ortolivo

[11] Patent Number: 4,593,427

[45] Date of Patent: Jun. 10, 1986

[54] WATERPROOF SCOURING GLOVE

[76] Inventor: Thomas V. Ortolivo, 2211 NW. 41 Ave., Coconut Creek, Fla. 33066

[21] Appl. No.: 642,083

[22] Filed: Aug. 20, 1984

Related U.S. Application Data

[63] Continuation-in-part of Ser. No. 452,196, Dec. 22, 1982, abandoned.

[51] Int. Cl.[4] ..... A47L 13/18

[52] U.S. Cl. ..... 15/227; 2/161; 15/104.94; 51/391

[58] Field of Search ..... 15/104.94, 227; 51/391; 2/161 R; D2/373, 376

[56] References Cited

U.S. PATENT DOCUMENTS

| | | | |
|---|---|---|---|
| 1,559,114 | 10/1925 | Maranville | 15/227 |
| 4,038,787 | 8/1977 | Bianchi | 51/391 |
| 4,051,572 | 10/1977 | Greenwood | 15/227 |
| 4,065,826 | 1/1978 | Hough | 15/227 |

FOREIGN PATENT DOCUMENTS

| | | | |
|---|---|---|---|
| 192125 | 9/1906 | Fed. Rep. of Germany | 15/227 |
| 2278277 | 2/1976 | France | 15/227 |
| 460385 | 11/1950 | Italy | 15/227 |
| 6704835 | 10/1967 | Netherlands | 15/227 |

*Primary Examiner*—Edward L. Roberts

*Attorney, Agent, or Firm*—Malin, Haley & McHale

[57] ABSTRACT

There is herein disclosed a cleaning and scouring glove having a flexible body including a palm, a thumb, and finger stalls, the finger stalls including a second row of phalanges. Disposed upon the second row of phalanges in the knuckle area of the middle three fingers are three ovoid scouring or cleaning units. In the palm and inner-finger region is located an upper and lower cleaning or abrasive surface, the upper surface covering substantially the entire upper-palm and inner-finger area, and the lower surface covering substantially the entire lower-palm area, the upper and lower surfaces being separated by a transverse linear separation of about ⅛ inch, this linear separation corresponding generally to the natural transverse fold in the palm, the separation functioning to enhance the flexibility of the palm area of the glove to facilitate the complete clenching of the fist of the user in order to make possible the application of considerable force and pressure by the user when the cleaning glove is held in a position of a clenched fist with pressure and reciprocal motion applied by the user between the second row of phalanges of the knuckle and the rigid surface to be cleaned by the disclosed waterproof cleaning glove. Also disclosed are means for the attachment and removability of the cleaning surfaces and units to provide a range of different cleaning mechanisms. The cleaning units may include a cellulose layer capable of rotating detergent in solution.

8 Claims, 5 Drawing Figures

Fig. 2.
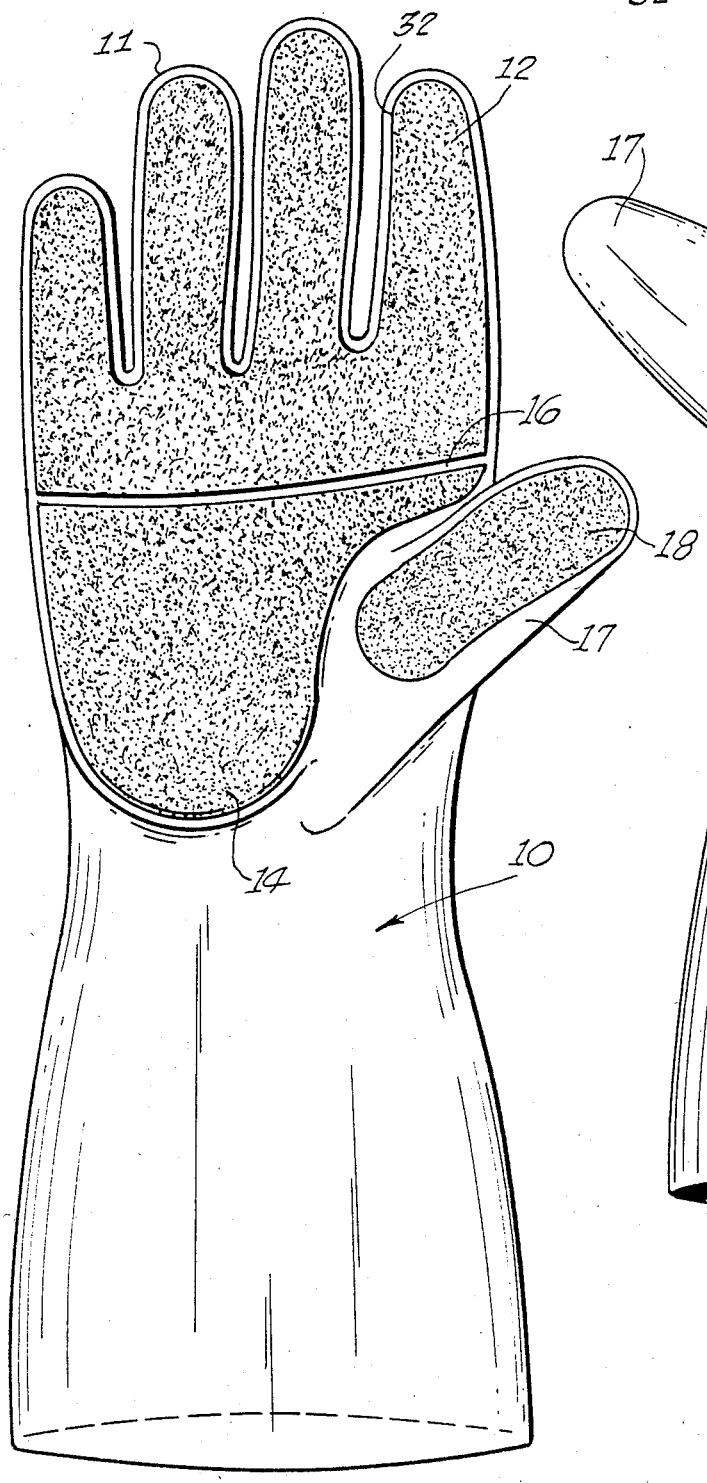
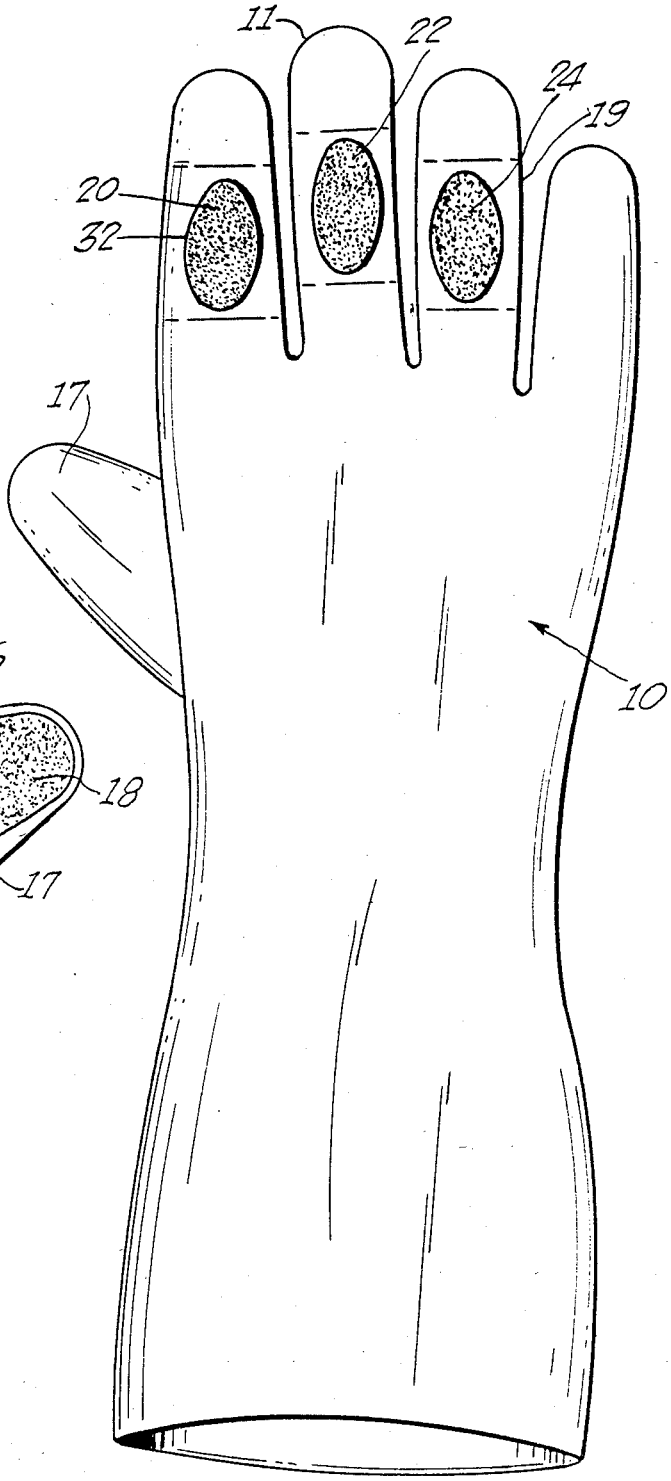
Fig. 1.

WATERPROOF SCOURING GLOVE

REFERENCE TO RELATED APPLICATION

This case is a continuation-in-part of Ser. No. 452,196, filed Dec. 22, 1982, and now abandoned, entitled "Waterproofed Two-Sided Scouring Glove".

BACKGROUND OF THE INVENTION

The present invention relates to gloves and, more particularly to waterproof gloves having abrasive scouring surfaces for purposes of cleaning.

Heretofore, waterproofed gloves and mittens, have been used to protect the user's hands from harsh detergents and other chemicals necessary in most cleaning operations. In addition, steel wool and other such fiberous abrasives have been used to accomplish the cleaning of surfaces of various types.

In some instances, abrasive cleaning surfaces have been attached to certain gloves or mittens, including gloves or mittens which are waterproof. To the knowledge of the inventor, these abrasive or cleaning surfaces have been attached to the gloves adjacent to or at the palm area of the particular glove. The prior art in this respect is explified by U.S. Pat. Nos. 2,459,521 to Woodbury; 3,643,386 to Grizyll; and 4,038,787 to Bianchi; as well as French Pat. No. 2,278,277 to Scott.

The above and other art known to the Inventor relates only to the attachment of the abrasive or cleaning material to the palm area. The problem encountered therein is the palm of the user is soft and, therefore, is not as effective for the cleaning of difficult surfaces as is a scouring stone or other material having a rigid abrading surface. Further, in that the area of the palm is relatively large, the pounds per square inch that may be applied therefrom, to the working surface, is relatively small.

A shortcoming in prior art cleaning gloves has been the lack of physical flexibility, their incapacity to act as a sponge in order to accomplish the absorbtion and retention of detergents in solution, and the single cleaning purpose thereof, i.e., particularity of the cleaning surface for which a given cleaning abrasive glove may be used.

The inventor has discovered that the location of cleaning or scouring units upon the outer portion of the glove and, more particularly, upon the second row of phalanges of the middle three fingers of the hand of the user, will make possible the application of many more pounds per square inch of force than is possible in the usage of the palm of the hand as a cleaning or scouring means.

The inventor has also discovered a usage, and interrelationship of usage, of certain materials for (a) the glove proper and (b) the cleaning or abrasive material that, in combination, provide enhanced effectiveness in terms of cleaning capability, variety of material that may be cleaned, and comfort to the user.

The present invention is believed to be properly classified in one or more of the following areas: U.S. Class 2, Subclass 161; Class 51, Subclass 391; and Class 242, Subclass 15.

SUMMARY OF THE INVENTION

The instant invention comprises a waterproof cleaning or scouring glove having a flexible body including a palm, a thumb and finger stalls, the finger stalls including a second row of phalanges. Disposed upon the second row of phalanges, in the knuckle area, of the middle three fingers are three ovoid scouring or cleaning units. In the palm and inner-finger region is disposed an upper and lower cleaning or abrasive surface, the upper surface covering substantially the entire upper-palm and inner-finger area, and the lower surface covering substantially the entire lower-palm area, said upper and lower surfaces separated by a transverse, linear separation of about ⅛ inch, said separation functioning to enhance the flexibility of the palm area of the glove. The cleaning or abrading unit may also be added to the inner-thumb area of the present flexible glove.

Due to the particular disposition of the ovoid abrading units upon the second row of phalanges, considerable force and pressure may be applied by the user when the present inventive glove is held in the position of a clenched fist.

It is accordingly a general object of the present invention to provide a glove having a flexible body including a palm, a thumb, and finger stalls having abrasive or cleaning surfaces on the palm side thereof and on the other side, especially designed surfaces upon the second row of phalanges of the middle fingers adapted for use by the user when his fist is clenched.

It is another object of the invention to provide a scouring surface that will interact with the flat, skeletal, thinly sheathed middle finger region of the hand of the user upon which considerable leverage may be developed.

It is a further object of the invention to provide a scouring or cleaning surface on the mid-portion of the finger of the waterproof glove upon which pressure from the shoulder of the user may be exerted.

It is a yet further object to provide a glove of the above set forth type including ovoid abrading units in the knuckle region on the hand of the user.

It is still further object to provide a scouring glove of the above type including cleaning or abrasive surfaces upon the inner-palm and inner-finger portion of the scouring glove, while retaining considerable flexibility thereof.

It is a further object to provide a cleaning glove of the above type in which the abrading units are capable of absorbing and retaining a detergent solution.

It is still further object of the invention to provide a cleaning glove of the above set forth type in which the cleaning units may be physically removed from the glove substrate and replaced by different abrading or cleaning units.

The above and yet further objects and advantages of the present invention will become apparent from the hereinafter set forth Detailed Description of the Invention, the Drawings, and Claims appended herewith:

BRIEF DESCRIPTION OF THE DRAWINGS

FIG. 1 is a view of the knuckle side of the glove showing the ovoid cleaning surfaces upon the second row of phalanges.

FIG. 2 is a perspective view of the palm side of the glove showing the upper and lower palm side abrading surfaces and the abrading surface upon the thumb.

DETAILED DESCRIPTION OF THE INVENTION

Figure 3:
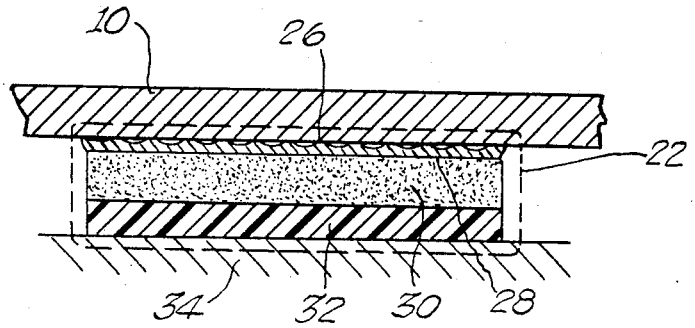
FIG. 3 is a cross-sectional fragmentary view of one embodiment of a cleaning and abrading unit.

With reference to FIG. 1, there is shown therein the backhand or knuckle side of a waterproof cleaning glove having a flexible body 10, said flexible body including fingers 11, a thumb 17 and palm areas 12 and 14 that are more clearly shown in FIG. 2.

On the glove body 10 are disposed a plurality of ovoid scouring or cleaning units 20, 22 and 24. These units are all disposed upon the second row of phalanges 19 of the knuckle area. See FIG. 1.

Figure 4:
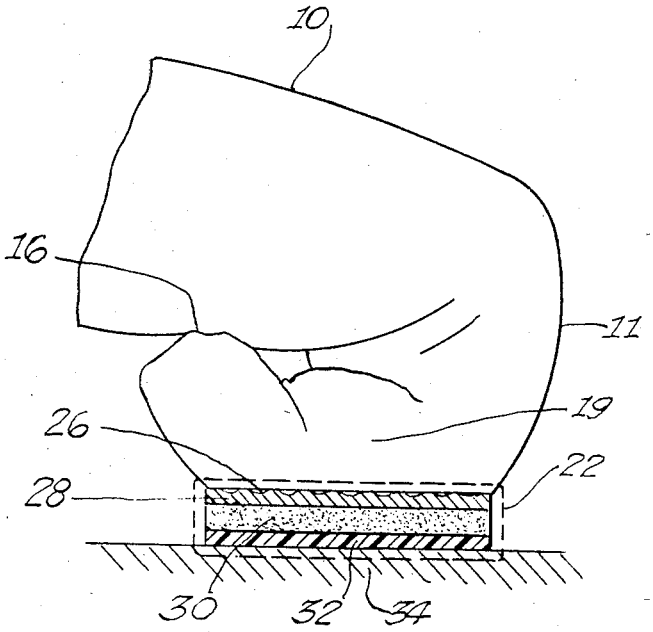
FIG. 4 is a conceptual illustration of the glove held in a clenched fist position, thus showing the manner of usage of the abrading units of the second row of phalanges.

As is more fully shown in FIG. 4, when the fingers of the user are held in a position of a clenched fist, the ovoid units will mate, in a co-planer manner, with a rigid surface 34 such that, particularly when leverage from the shoulder is applied, much of the body weight of the user may be transmitted to the second row of knuckle phalanges. This, it has been found, will result in considerably a greater force per square inch than is possible through the traditional application of force by the palm area of the user. Additionally, it has been found that the use of ovoid abrading or cleaning units, as opposed to square, rectangular, or circular units, will result in an enhanced durability in use-life of the scouring units, particularly when the major axis of the ovoid is disposed in the direction of reciprocation of the glove against the cleaning surface, during usage.

With respect to the inner or palm side of the scouring glove, this is shown in FIG. 2, including an upper-finger and palm area 12 covering the entire fingers of the inner-hand and extending to the natural transverse fold of the palm. Below the upper-palm area 12 is the lower-palm area 14 which follows the natural curvature of the palm down to the beginning of the wrist. The upper and lower palm areas 12 and 14 respectively are separated by a uniform linear gap 16 having a width of approximately ⅛ of an inch. The purpose of this uniform linear gap is to enhance flexibility of the glove in the inner-palm area by enhancing the degree to which the fist of the user may be clenched to obtain the position of the fully clenched fist shown in FIG. 4.

With reference to the thumb area 17, this is provided with an abrading unit 18 which follows the general shape of the end of the thumb.

With regard to the nature and structure of the cleaning or abrading material that may be employed for the various cleaning surfaces and units, reference is made to FIG. 3 in which there is shown, disposed upon flexible body 10, an adhesive 28 which acts to bond an absorptive layer 30 to said flexible body 10. Integrally formed with the absorptive layer 30 is a working material 32 which, for example, may comprise a cellulose foam material known commercially as scrunge. Other working or abrading materials include nylon abrasives and sand contact abrasives.

The absorptive layer 30 preferably comprises a cellulose material capable of retaining a detergent in solution until it is pressure-urged into and through the layer 32 of working material onto the rigid surface 34.

In order to enhance the suitability of the flexible body 10 for receipt of the adhesive 28, the flexible body 10 may be provided with an undulating or gritted surface 26. On such undulating surface 26, the adhesive 28 is placed and, thereto, the absorptive layer 30 bonded.

It is to be appreciated that the structure illustrated in FIG. 3 and described above represents but one embodiment reflective of the instant invention. As an alternative thereof, the absorptive layer 30 may be omitted and the working material 32 adhered directly to the flexible body 10 of gritted surface 26. Where this occurs, the working material 32 will, preferably, have absorptive properties where the character of the detergent or cleaning agent calls for such properties.

It is also noted that the flexible glove body may be formed of materials such as latex or neoprene.

It should be additionally understood that the working material 32 may encompass many types of cleaning and/or abrading elements including polishing elements. Also, the working material 32 may be porous, washable and, as above noted, may or may not be adapted for interface and usage with an absorptive layer such as layer 30.

Additionally, it has been noted that the working material 32 may be pre-impregnated with a cleaning agent.

A further feature of one or more embodiments of the present invention involves the removability of the abrading or cleaning surface from the flexible body through the usage of a pressure-adhering and pressure-releasable adhesive 28 such as DEVCON rubber contact cement. Where such a bonding agent, which is responsive to both positive and negative pressure, is utilized with the working material, either with or without the absorptive layer 30, the working material 32 becomes removable from the flexible glove body 10. In this situation, it becomes entirely impossible to change abrading or cleaning surfaces as may be required or dictated by the type of surface 34 to be cleaned. Thereby, rather than a requirement for many different gloves, each with a different type of working surface, as has occurred in the prior and present state-of-the-art, a single glove could be used and re-used many times, by simply pulling-off the working material 32 and replacing it by a different working material. The above, in addition to being accomplished by a pressure-sensitive glue, may also be accomplished through the use of a velcro-like material.

Figure 5:
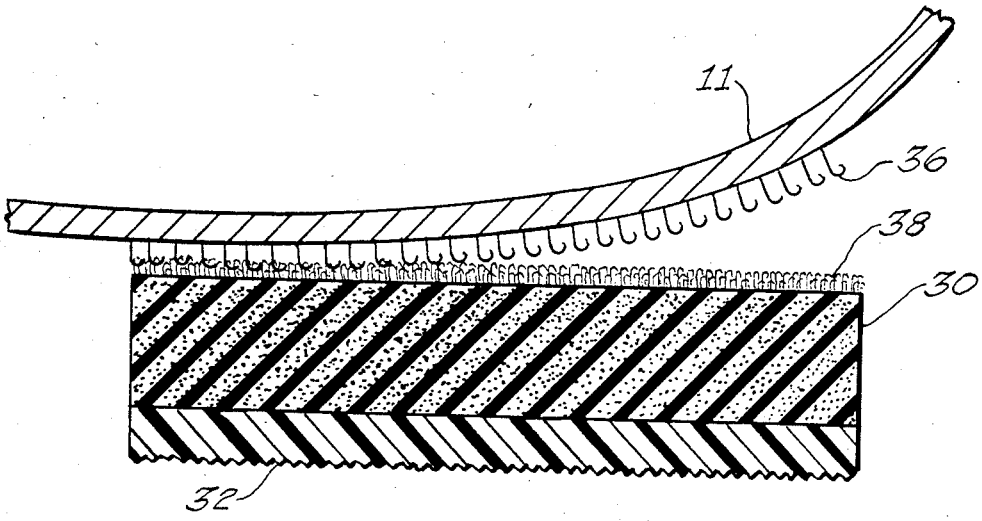
FIG. 5 is a conceptual illustration of the abrading material with an absorptive layer and a "Velcro" connection.

FIG. 5 shows the abrading material 32 and the absorptive layer 30 connectable to glove 11 by hooks 36 and material 38.

With reference to the configuration of the ovoid units 20, 22 and 24, disposed upon the second row of knuckle area phalanges, it has been found that the optimum ratio of the major-to-minor axes thereof is 2 to 1 and, as noted above, the disposition of the major axis thereof in alignment with the primary axis of reciprocation of the knuckle, when clenched as shown in FIG. 4, has been found to extend the life of the abrading units.

While it has been shown and described the preferred embodiments of the present invention, it will be understood that the invention may be embodied otherwise than as herein specifically illustrated and described; and that within said embodiments certain changes in the detail and consruction, and the form and arrangement of the parts, may be made without departing from the underlying idea or principles of this invention within the scope of the appended claims.

Having thus described my invention, what I claim as new, useful and non-obvious and, accordingly, secure by Letters Patent of the United States is:

1. A waterproof scouring glove for cleaning rigid surfaces and having a flexible body including a palm, a thumb, and finger stalls, the finger stalls including a second row of phalanges in the mid-finger area, the scouring glove comprising:

an exterior palm side and an exterior knuckle side, a plurality of abrading or cleaning units defining cleaning surfaces and adhered to only said exterior palm side and only said exterior knuckle side of said second row of phalanges and positioned entirely within the confines thereof, whereby, the second row of phalanges may be utilized for forcibly applying pressure to said cleaning unit during scrubbing of a rigid surface when said glove is in the position of a clenched fist and, during such clenching, the second row of phalanges are capable of forcefully applying reciprocating action upon the rigid surface, said abrading or cleaning units including a single upper exterior palm cleaning surface covering substantially the entire upper exterior palm and exterior palm side finger areas of the glove body; and a single lower exterior palm cleaning surface covering substantially the entire lower palm area extending from the natural transverse crease in the palm to the top of the wrist, wherein said upper and said lower-cleaning surfaces are separated by a transverse linear gap free of abrading or cleaning units disposed substantially at the location of the natural transverse crease of the palm;

whereby the capacity of the user to form a tight, clenched fist is enhanced by reason of such transverse linear separation between said upper and lower palm surfaces, an absorption layer disposed between said cleaning surfaces and the flexible glove body;

whereby said absorptive layer may absorb water of a liquid solution of detergent for usage in combination with said cleaning surfaces;

said absorptive layer is adhered to the flexible glove body with a pressure-responsive adhesive.

2. The scouring glove as recited in claim 1 which said pressure-responsive adhesive comprising responsiveness to both position and negative pressure, whereby the cleaning surfaces may be both adhered and removed through the application of positive or negative pressure respectively, relative to the flexible glove body thereby providing for interchangeability of cleaning surfaces.

3. A waterproof scouring glove for cleaning rigid surfaces and having a flexible body including a palm, a thumb, and finger stalls, the finger stalls including a second row of phalanges in the mid-finger area, the scouring glove comprising:

an inner palm side and an outer knuckle side, a plurality of abrading or cleaning units defining cleaning surfaces and adhered to only the outer side and only said second row of phalanges and positioned entirely within the confines thereof, whereby the second row of phalanges may be utilized for forcibly applying pressure to said cleaning units during scrubbing of a rigid surface when said glove is in the position of a clenched fist and, during such clenching, the second row of phalanges are capable of forcefully applying reciprocating action upon the rigid surface, an absorption layer disposed between said cleaning surfaces and the flexible glove body;

whereby said absorptive layer may absorb water of a liquid solution of detergent for usage in combination with said cleaning surfaces, an upper cleaning surface covering substantially the entire upper palm and inner finger area of the glove body; and a lower cleaning surface covering substantially the entire lower palm area extending from the natural transverse crease in the palm to the top of the wrist, wherein said upper and lower cleaning surfaces are separated by a transverse linear gap disposed substantially at the location of the natural transverse crease of the palm;

whereby the capacity of the user to form a tight, clenched fist is enhanced by reason of such transverse linear separation between said upper and lower palm surfaces, an absorption layer disposed between said upper and lower cleaning surfaces and the flexible glove body;

whereby said absorptive layer may absorb water of a liquid solution of detergent for usage in combination with said upper and lower cleaning surfaces;

said absorptive layer is adhered to the flexible glove body with a pressure-responsive adhesive.

4. The scouring glove as recited in claim 3 is which said flexible glove body includes a grit-like surface adapted for the receipt of a bonding adhesive suitable to secure the absorptive layer to the glove body.

5. The scouring glove as recited in claim 3 further comprising a "Velcro" interface between the flexible glove body and the cleaning surfaces, thereby providing for removability of the cleaning surfaces from the flexible glove body.

6. The scouring glove as recited in claim 3 in which the cleaning surfaces may be selected from the group consisting essentially of metallic abrasives, nylon abrasives, and sand contract abrasives.

7. A waterproof scouring glove for cleaning rigid surfaces and having a flexible body including a palm, a thumb, and finger stalls, the finger stalls including a second row of phalanges in the mid-finger area, the scouring glove comprising:

an exterior palm side and an exterior knuckle side, a plurality of abrading or cleaning units defining cleaning surfaces and adhered to only said exterior palm side and positioned entirely within the confines thereof, said abrading or cleaning units including a single upper exterior cleaning surface covering substantially the entire uppper exterior palm and exterior palm side finger areas of the glove body; and a single lower exterior palm cleaning surface covering substantially the entire lower palm area extending from the natural transverse crease in the palm to the top of the wrist;

an absorption layer disposed between said cleaning surfaces and the flexible glove body;

whereby said absorptive layer may absorb water of a liquid solution of detergent for usage in combination with said cleaning surface, said absorptive layer is connected to the flexible glove body and said abrading or cleaning units.

8. A waterproof scouring glove for cleaning rigid surfaces and having a flexible body including a palm, a thumb, and finger stalls, the finger stalls including a second row of phalanges in the mid-finger area, the scouring glove comprising:

an exterior palm side and an exterior knuckle side, a plurality of abrading or cleaning units defining cleaning surfaces and adhered to only said exterior knucke side of said second row of phalanges and positioned entirely within the confines thereof, whereby the second row of phalanges may be utilized for forcibly applying pressure to said cleaning unit during scrubbing of a rigid surface when said glove is in the position of a clenched fist and, during such clenching, the second row of phalanges are capable of forcefully applying reciprocating action upon the rigid surface, an absorption layer disposed between said cleaning surfaces and the flexible glove body;

whereby said absorptive layer may absorb water of a liquid solution of detergent for usage in combination with said cleaning surface, absorptive layer is connected to the flexible glove body and said abrading or cleaning units.

* * * * *